US009739278B2

(12) United States Patent
Holbrook et al.

(10) Patent No.: US 9,739,278 B2
(45) Date of Patent: Aug. 22, 2017

(54) MULTI-STAGE VACUUM PUMP

(71) Applicant: Edwards Limited, Crawley, West Sussex (GB)

(72) Inventors: Alan Ernest Kinnaird Holbrook, Pulborough (GB); Sivabalan Kailasam, Gyeonggi-do (KR); Ross Gordon Eadie, Chichester (GB)

(73) Assignee: Edwards Limited, Crawley (GB)

( * ) Notice: Subject to any disclaimer, the term of this patent is extended or adjusted under 35 U.S.C. 154(b) by 422 days.

(21) Appl. No.: 14/219,769

(22) Filed: Mar. 19, 2014

(65) Prior Publication Data

US 2014/0286806 A1 Sep. 25, 2014

(30) Foreign Application Priority Data

Mar. 20, 2013 (GB) ..... 1305090.1

(51) Int. Cl.

| | |
|---|---|
| ***F01C 19/00*** | (2006.01) |
| ***F04C 27/00*** | (2006.01) |
| ***F01C 21/10*** | (2006.01) |
| ***F04C 23/00*** | (2006.01) |
| ***F04C 25/02*** | (2006.01) |
| *F04C 18/12* | (2006.01) |

(52) U.S. Cl.

CPC ..... *F04C 27/006* (2013.01); *F01C 19/005* (2013.01); *F01C 21/10* (2013.01); *F04C 23/008* (2013.01); *F04C 25/02* (2013.01); *F04C 27/001* (2013.01); *F04C 18/123* (2013.01); *F04C 18/126* (2013.01)

(58) Field of Classification Search

CPC ..... F04C 27/006; F04C 23/008; F04C 25/02; F04C 27/001; F04C 18/126; F04C 18/123; F01C 19/005; F01C 21/10

USPC ..... 418/5, 9, 149; 417/244; 415/1

See application file for complete search history.

(56) References Cited

U.S. PATENT DOCUMENTS

2002/0155014 A1* 10/2002 Durand et al. ..... 418/9

FOREIGN PATENT DOCUMENTS

GB 2489248 A * 9/2012 ..... F04B 25/00

OTHER PUBLICATIONS

Combined Search and Examination Report under Sections 17 and 18(3) dated Sep. 19, 2013 from the GB Intellectual Property Office in corresponding GB Application No. 1305090.1, 5 pgs.

* cited by examiner

*Primary Examiner* — Thai Ba Trieu
*Assistant Examiner* — Loren Edwards
(74) *Attorney, Agent, or Firm* — Shumaker & Sieffert, P.A.

(57) ABSTRACT

A multi-stage vacuum pump may include a sealing arrangement for sealing between the stator components of the pump. The end seals of the arrangement comprise an annular portion for sealing between end stator components and shell components and axial portions which extend from the annular portion and together with separate axial seals seal between the shell components.

23 Claims, 6 Drawing Sheets

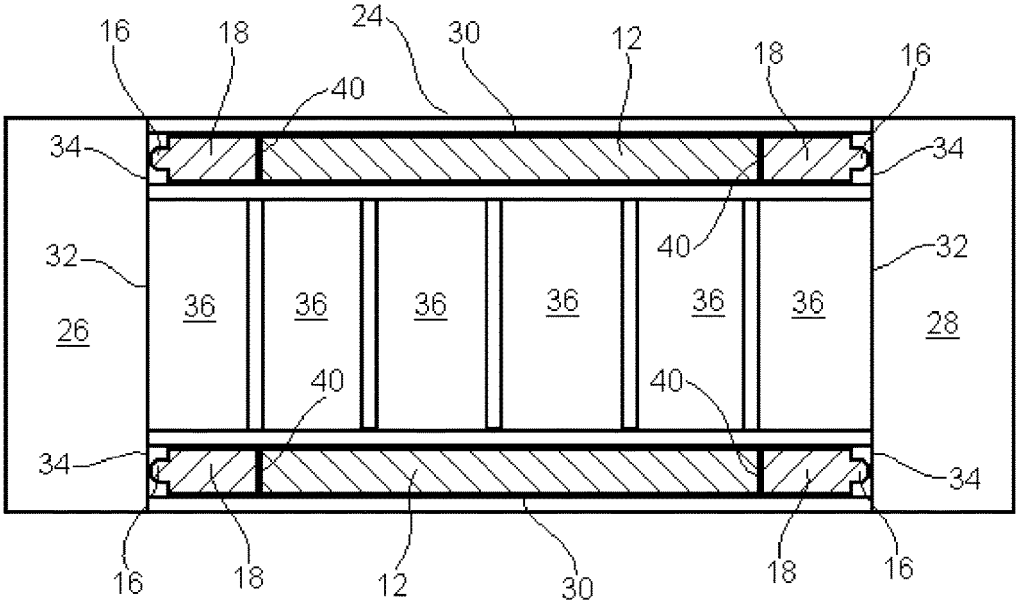
FIG. 3
FIG. 4
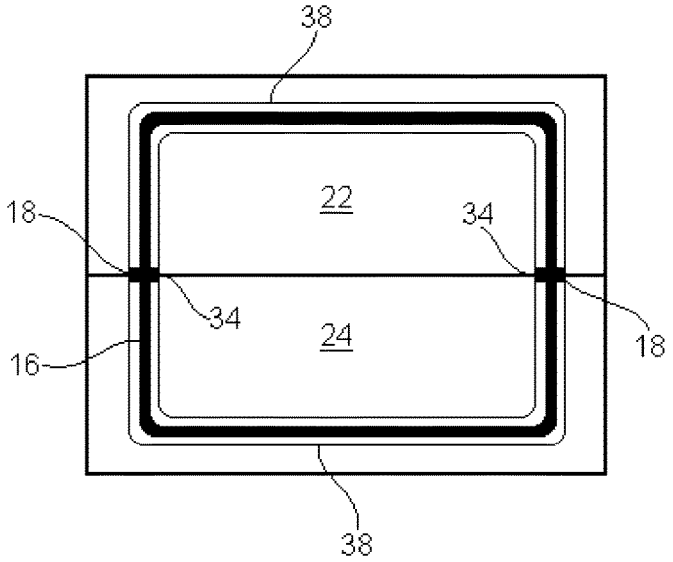

MULTI-STAGE VACUUM PUMP

This application claims the benefit of G.B. Application 1305090.1, filed Mar. 20, 2013. The entire content of G.B. Application 1305090.1 is incorporated herein by reference.

TECHNICAL FIELD

The disclosure relates to a multi-stage vacuum pump and a stator of such a pump.

BACKGROUND

A vacuum pump may be formed by positive displacement pumps such as roots or claw pumps, having one or more pumping stages connected in series. Multi-stage pumps are desirable because they involve less manufacturing cost and assembly time compared to multiple pumps in series.

Multi-stage roots or claw pumps may be manufactured and assembled in the form of a clamshell. As shown in FIG. 12, the stator 100 of such a pump comprises first and second half-shell stator components 102, 104 which together define a plurality of pumping chambers 106, 108, 110, 112, 114, 116. Each of the half-shells has first and second longitudinally extending faces which mutually engage with the respective longitudinally extending faces of the other half-shell when the half-shells are fitted together. Only the two longitudinally extending faces 118, 120 of half-shell 102 are visible in the Figure. During assembly the two half shells are brought together in a generally radial direction shown by the arrows R.

The stator 100 further comprises first and second end stator components 122, 124. When the half-shells have been fitted together, the first and second end components are fitted to respective end faces 126, 128 of the joined half-shells in a generally axial, or longitudinal, direction shown by arrows L. The inner faces 130, 132 of the end components mutually engage with respective end faces 126, 128 of the half-shells.

Each of the pumping chambers 106-116 is formed between transverse walls 134 of the half-shells. Only the transverse walls of half-shell 102 can be seen in FIG. 12. When the half-shells are assembled the transverse walls provide axial separation between one pumping chamber and an adjacent pumping chamber, or between the end pumping chambers 106, 116 and the end stator components. The present example shows a typical stator arrangement for a roots or claw pump having two longitudinally extending shafts (not shown) which are located in the apertures 136 formed in the transverse walls 134 when the half-shells are fitted together. Prior to assembly, rotors (not shown) are fitted to the shafts so that two rotors are located in each pumping chamber. Although not shown in this simplified drawing, the end components each have two apertures through which the shafts extend. The shafts are supported by bearings in the end components and driven by a motor and gear mechanism.

The multi-stage vacuum pump operates at pressures within the pumping chamber less than atmosphere and potentially as low as 10-3 mbar. Accordingly, there will be a pressure differential between atmosphere and the inside of the pump. Leakage of surrounding gas into the pump must therefore be prevented at the joints between the stator components, which are formed between the longitudinally extending surfaces 118, 120 of the half-shells and between the end faces 126, 128 of the half-shells and the inner faces 130, 132 of the end components.

SUMMARY

The present disclosure provides an improved seal arrangement for sealing a clam shell pump.

The present disclosure provides a multi-stage vacuum pump comprising: first and second shell stator components arranged to be assembled together along respective axially extending surfaces to define a plurality of pumping chambers along an axis of the pump; first and second end stator components arranged to be assembled at respective axial ends of the shell stator components; axial seals for sealing between respective axially extending surfaces of the shell stator components; and end seals having annular portions for sealing between respective first and second end stator components and the shell stator components and axial portions which extend in an axial dimension from the annular portions between the shell stator components for sealing between respective axially extending surfaces of the shell stator components.

Other preferred or optional features are defined in the dependent claims of the application provided below.

BRIEF DESCRIPTION OF DRAWINGS

In order that the present disclosure may be well understood, some embodiments thereof will now be described in more detail, with reference to the accompanying drawings in which:

FIG. 3 shows a half-shell stator component as viewed at an intersection between the half-shell stator components and the two end stator components in section with the sealing arrangement in place;

FIG. 4 shows an end view of the two half-shell stator components with the sealing arrangement in place;

DETAILED DESCRIPTION

Figure 12:
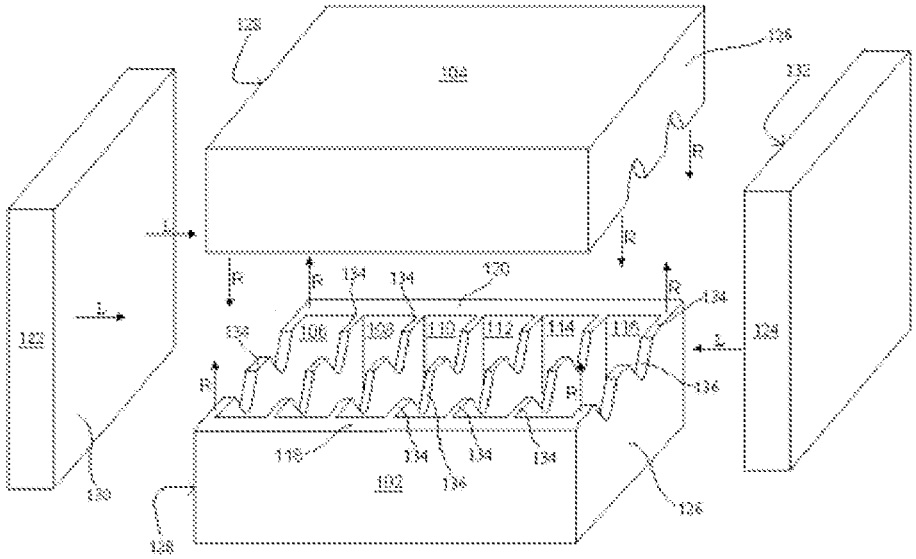
FIG. 12 shows a prior art stator of a vacuum pump.

The present applicant has filed two earlier patent applications GB1104781.8 and GB1221599.2, neither of which have been published at the filing date of the present application. Both of these applications are directed to a sealing arrangement for sealing a clam shell pump of the type described above in relation to FIG. 12. The earlier applications employ longitudinal seals for sealing between the half shell stator components and O-rings for sealing between the end stator components and the half shell stator components. A difficulty with this approach arises from maintaining an adequate seal between the longitudinal seals and the O-rings, and the two earlier applications provide means for overcoming this difficulty.

Figure 13:
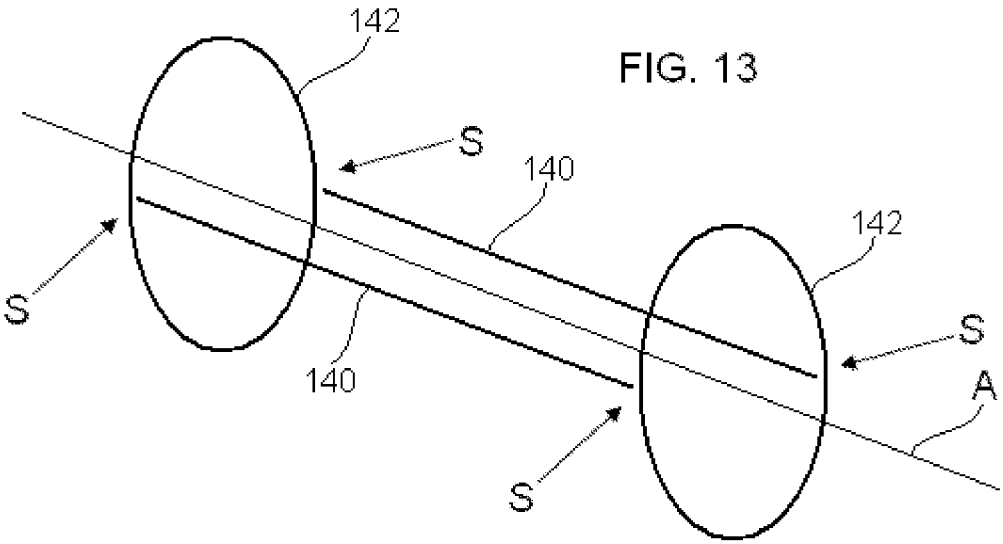
FIG. 13 shows schematically an earlier sealing arrangement of the present applicants.

A simplified sketch of the seal arrangement is shown in FIG. 13, which omits the stator components for clarity. The longitudinal seals 140 extend in a direction which is generally parallel to the axis A of the pump whilst the O-rings 142 extend in a plane which is radial to the axis of the pump and perpendicular to the longitudinal seals. The earlier applications are directed to maintaining contact between the longitudinal seals and the O-rings at the sealing regions referenced S in the sketch. In order to maintain contact, the longitudinal seals or the stator half shell components are modified to resist the movement of the longitudinal seals away from the O-rings at the sealing regions S. The approach adopted by the applicants in the earlier applications necessitates sealing in three-dimensions since the longitudinal seals and the O-rings are perpendicular to one another. The three dimensions are an axial dimension, and two perpendicular radial dimensions. It has been found that sealing in three-dimensions is complicated not least because the seals undergo expansion when compressed between the stator components during assembly and also undergo thermal expansion and contraction when the temperature of the pump changes during use.

Figure 1:
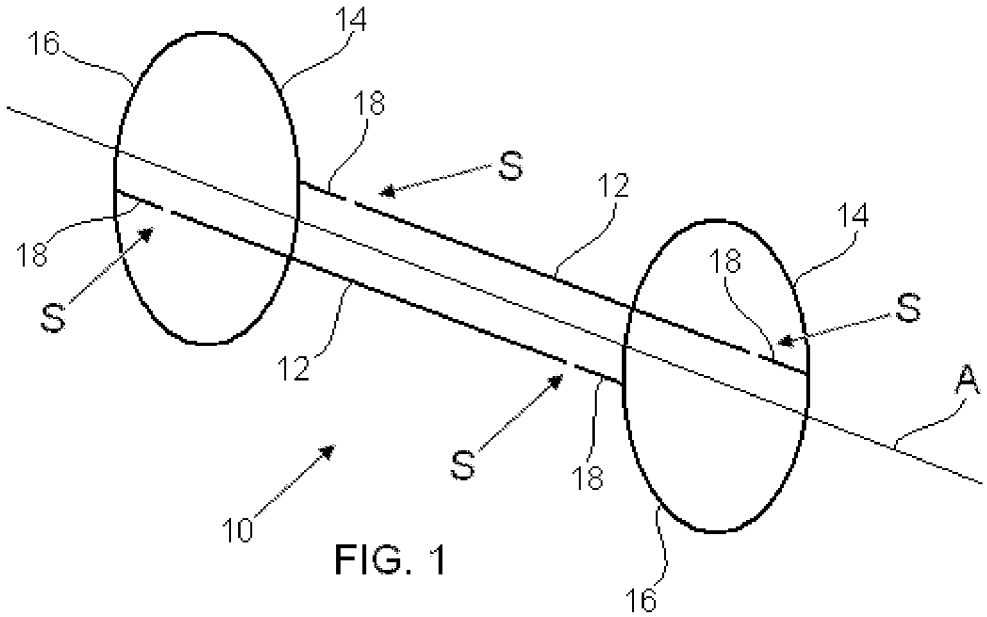
FIG. 1 shows schematically a sealing arrangement for a vacuum pump.

The applicant has solved the problem associated with sealing in three-dimensions by moving the point of contact between the longitudinal, or axial, seals and the O-rings, or annular seals. FIG. 1 is a highly simplified sketch showing a modified sealing arrangement 10 comprising axial seals 12 and end seals 14. The end seals 14 comprise an annular portion 16 formed generally by an O-ring, or annular seal, and two axial portions 18 which extend from the annular portion in a generally axial dimension and are integral with the annular portions. The ends of the axial seals 12 are spaced from the annular portions 16 approximately by the length of the axial portions 18.

Figure 2:
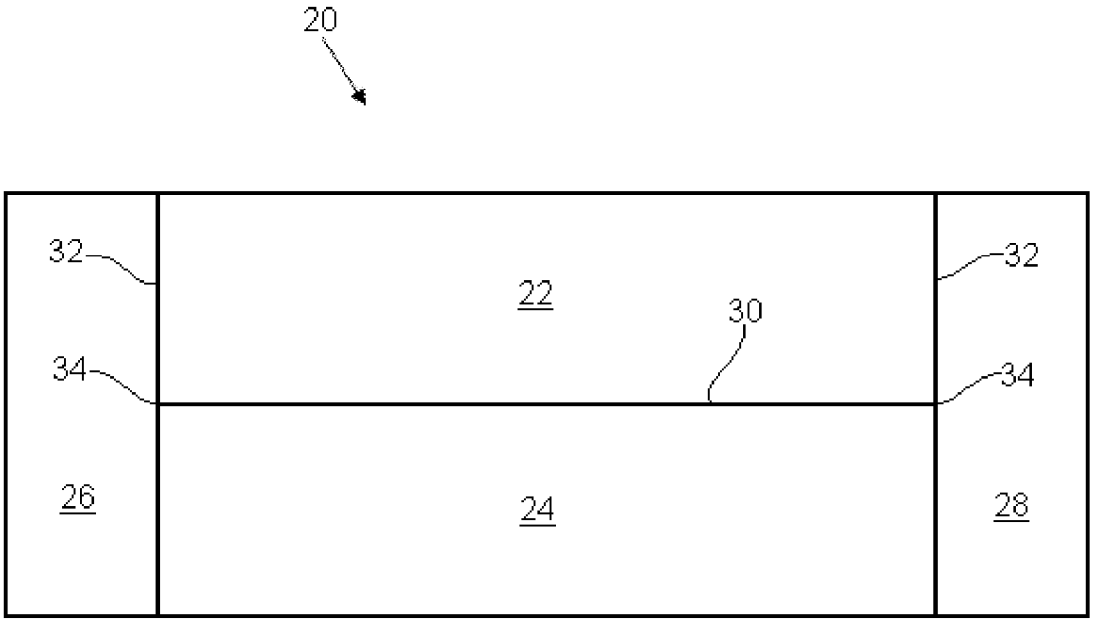
FIG. 2 shows schematically the stator components of a vacuum pump, including two half-shell stator components and two end stator components.

FIG. 2 shows the general arrangement of the stator components of a multistage pump as described above with reference to FIG. 12. The stator arrangement 20 is shown from one side and comprises first and second half shell stator components 22, 24 and end stator components 26, 28. The term half-shell stator component as used herein is not restricted to geometric halves of the stator but instead refers to two stator parts which are brought together during assembly along generally axially extending mutual surfaces. The half shell stator components are assembled together along axially extending surfaces 30 to define a plurality of pumping chambers along an axis of the pump. The end stator components are assembled at the axial ends of the half shell stator components along the transverse surfaces 32. T-junctions 34 are formed between the axially extending surfaces 30 and the transverse surfaces 32. The annular portions 16 of the end seals 14 seal between the transverse surfaces 32 of respective first and second end stator components and the half-shell stator components and the axial portions 18 of the end seals, together with the axial seals 12, seal between the axially extending surfaces 30 of the half-shell stator components. The sealing region S between the axial seals 12 and the end seals 14 is spaced away from the T-junctions 34.

A seal arrangement is shown in more detail in FIGS. 3 and 4. FIG. 3 is a section showing one half shell stator component 24 and the end stator components 26, 28. FIG. 4 shows the axial end of the first and second half shell stator components assembled together without an end stator component, but with an end seal in place.

Referring to FIG. 3, the axially extending surfaces 30 of the second half shell stator component 24 is formed by channels counter sunk on both lateral sides of the pumping chambers 36. The channels 30 have a width for receiving the axial seals 12 and the axial portions 18 of the end seals 14. The first half shell stator component may have similar channels forming axially extending surfaces 30 or may have a flat surface without channels. The provision of a channel in at least one of the half shell stator components facilitates location of the seals during assembly. When the seals are compressed between the axially extending surfaces 30 of the respective half shell stator components they undergo expansion and therefore the width of the seals may be less than the width of the channels to allow for such expansion.

Referring to FIG. 4, an annular channel 38 is provided in the axial end faces of both of the first and second half shell stator components 22, 24 for receiving the annular portion 16 of the end seals 14. The annular channel 38 intersects with the axially extending channels 30 at the T-junctions 34 between the half shell stator components. The annular portions 16 may have a width which is less than the width of the annular channel 38 to allow for expansion when the end stator components are fixed to the half shell stator components. In an alternative, the annular channels 38 may be provided in the end stator components 26, 28 or in both the end stator components and the axial ends of the half shell stator components.

Referring to both FIGS. 3 and 4, the annular portions 16 of the end seals 14 are generally tubular or cylindrical in cross-section similar to an O-ring. The end seals are formed from a moulded plastics material and the annular portions are formed integrally with the axial portions 18. As indicated above, the axial portions extend in an axial dimension from the annular portions between the half-shell stator components for sealing between respective axially extending surfaces of the half-shell stator components. Therefore the end seals 14 have a three-dimensional shape (i.e. the annular portions 16 in two dimensions and the axial portions 18 in a third dimension). Although moulding of three-dimensional shapes is more complicated than moulding two-dimensional shapes and typically more expensive, the end seals can be readily moulded in three-dimensions because the tooling required for manufacturing an O-ring can easily be modified for manufacturing an O-ring having generally linear portions extending therefrom, which then following moulding form the axial portions. For example, if the annular portions of the end seals are injection moulded between two tool parts, one of the parts can be formed with channels which serve the purpose of both guiding plastics into the annular portion and forming the axial portions. In this way, the end seals 14 can be formed in a single manufacturing step. Moreover, once the end seals have been manufactured they can easily be fitted in position in the annular channel 38 and the axial channel 30 without stretching the material of the end seals or otherwise placing stress on the material in the assembly process. More complicated three-dimensional shapes are generally to be avoided in view of the cost and complication of the manufacturing techniques required and also because fitting more intricate shapes to the assembly is a time consuming process which may involve stretching or otherwise stressing the material of the seal arrangement.

As indicated above, the annular portions 16 of the end seals 14 extend in planes transverse to, and typically radial to, the axis of the pump. The axial portions 18 extend generally perpendicularly from the annular portions when the annular portions are radial to the axis of the pump. The axial portions 18 abut respective axial seals 12 at a mutual contact surface 40 for resisting passage of gas between the axial portions and axial seals along the contact surface. The contact surface is either linear as shown in FIG. 3 or two dimensional as shown in the subsequent Figures, rather than the three dimensions of the applicant's earlier arrangements.

Further examples of the present sealing arrangement are shown in the following FIGS. 5 to 11. These Figures show a section taken along an axially and radially extending plane of the region S, which typically is horizontal when the pump is in an upright orientation. The examples extend the sealing surface compared to the sealing surface of the FIG. 3 arrangement in order to provide greater resistance to gas leakage. In this regard, it will be noted that the pressure differential across the seals is significant in a vacuum pump and may be between 1 bar and 10-3 mbar giving a pressure differential of one million.

Figure 5:
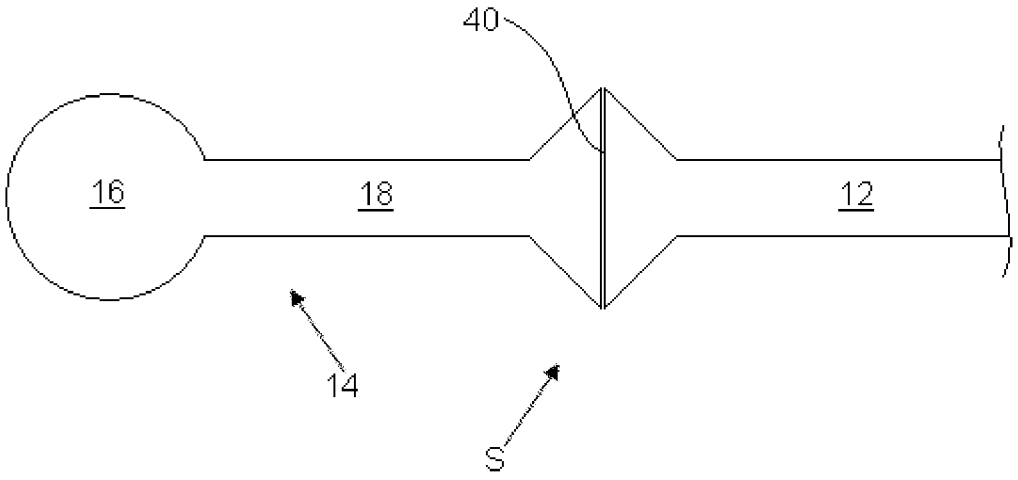
FIGS. 5 to 11 show a sealing region of various examples of a sealing arrangement.

Referring to FIG. 5, the axial portions 18 of the annular seals 14 extend generally axially from the annular portion 16 to abut against the axial seals 12 at a mutual contact surface 40. The axial portions and the axial seals are enlarged at the mutual contact surface to increase the length of the surface. As shown, both the axial portions and the axial seals taper outwardly towards the contact surface 40 to increase the length of the sealing surface.

Figure 6:
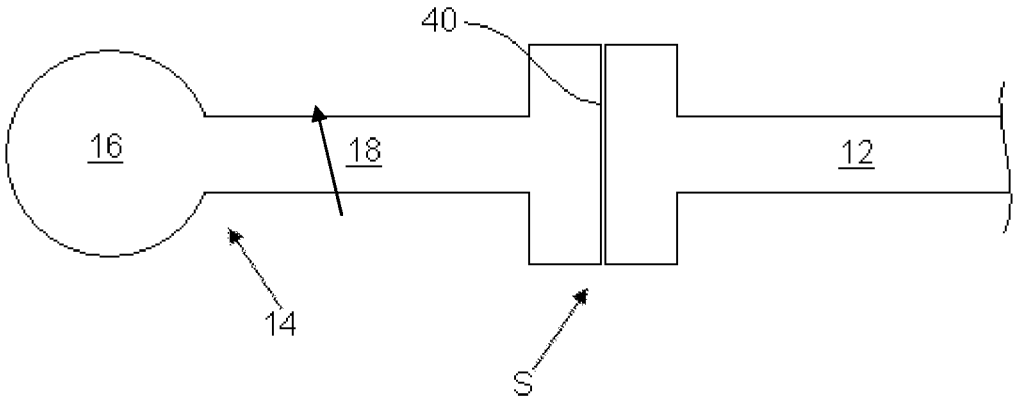

Referring to FIG. 6, the axial portions 18 of the annular seals 14 extend generally axially from the annular portion 16 to abut against the axial seals 12 at a mutual contact surface 40. The axial portions and the axial seals are enlarged at the mutual contact surface to increase the length of the surface. As shown, both the axial portions and the axial seals are enlarged to form a generally rectangular shaped radial extension towards the contact surface 40 to increase the length of the sealing surface. The axially extending channels of the half-shell stator components are shaped to correspond with the enlarged regions of the seal parts. In this way, the channels act as mechanical obstacle to prevent the seals from pulling apart during thermal cycles.

Figure 7:
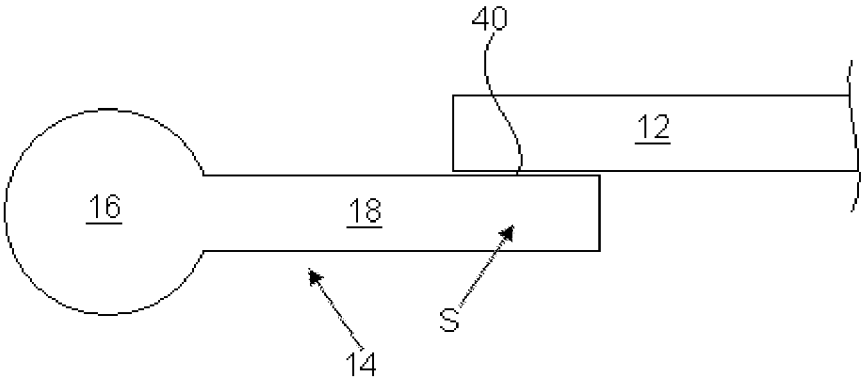

Referring to FIG. 7, the axial portions 18 and the axial seals 12 are arranged to overlap in the axial direction to provide a sealing surface 40 which extends in an axial direction. In this way, the axial portions and axial seals are shaped at the mutual contact surface to increase the length of the mutual contact surface beyond the extent of the axial portions and axial seals in that plane.

Figure 8:
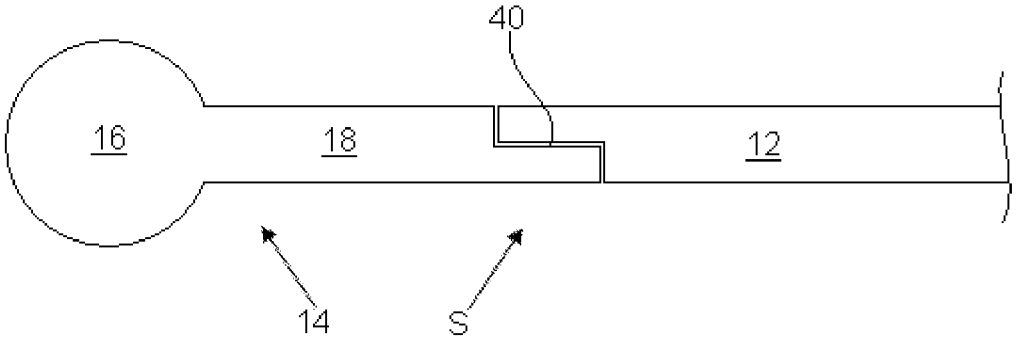

Referring to FIG. 8, the axial portions 18 and the axial seals 12 interlock at the mutual contact surface 40 to increase the length of the mutual contact surface and resist disengagement of the axial portions from the axial seals. As shown in this Figure, the sealing surface is tortuous and extends through two rights angles which further helps to resist leakage of gas.

Figure 9:
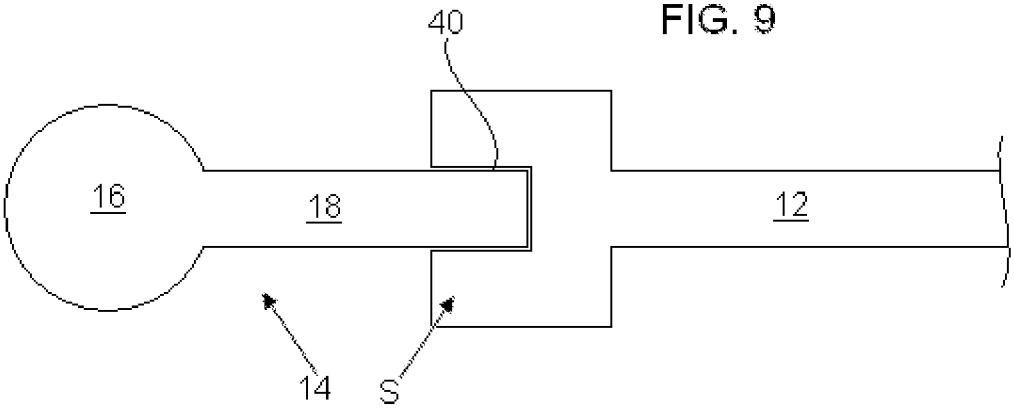

FIG. 9 shows an arrangement in which similarly to FIG. 8, the axial portions 18 and the axial seals 12 interlock at the mutual contact surface 40 to increase the length of the mutual contact surface and resist disengagement of the axial portions from the axial seals. In this latter arrangement, the axial portions 18 are generally linear and extend axially, whilst the axial seals 12 are enlarged to encompass an end of the axial portions. Alternatively, the axial seals can be linear whilst the axial portions are enlarged. The embodiments in FIGS. 7, 8 and 9 allow the seals to slide apart and back together axially during thermal cycles, whilst retaining contact with each other throughout and maintaining a seal at all times.

Figure 10:
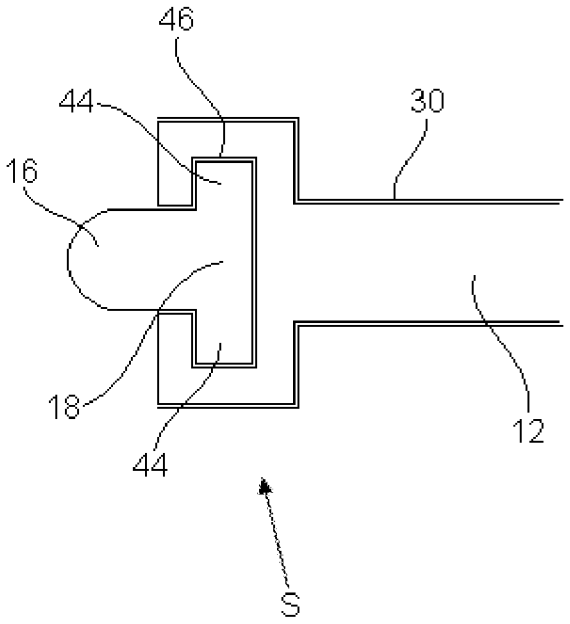

FIG. 10 shows another example of a sealing region S in which interlocking between the axial portions 18 and the axial seals 12 is enhanced. In this regard, the axial portions 18 extend generally axially from the annular portions 16 of the end seals 14. The axial portions have radially extending shoulders 44 which project outwardly to form a T-shaped portion. The axial seal 12 is enlarged to form a T-shaped recess 46 which interlocks with the T-shaped formation of the axial portions. The channel 30 of the half shell stator component is shown in this Figure and is shaped to accommodate the enlarged regions of the axial portions 18 and the axial seals 12. The enhanced interlocking arrangement resists movement of the axial portions 18 and the axial seals 12 away from one another, for example during thermal contraction. Additionally, the sealing surface comprises multiple changes in direction to further resist gas leakage. In an alternative the axial seal may comprise a T-shaped formation and the axial portion may comprise a T-shaped recess.

Figure 11:
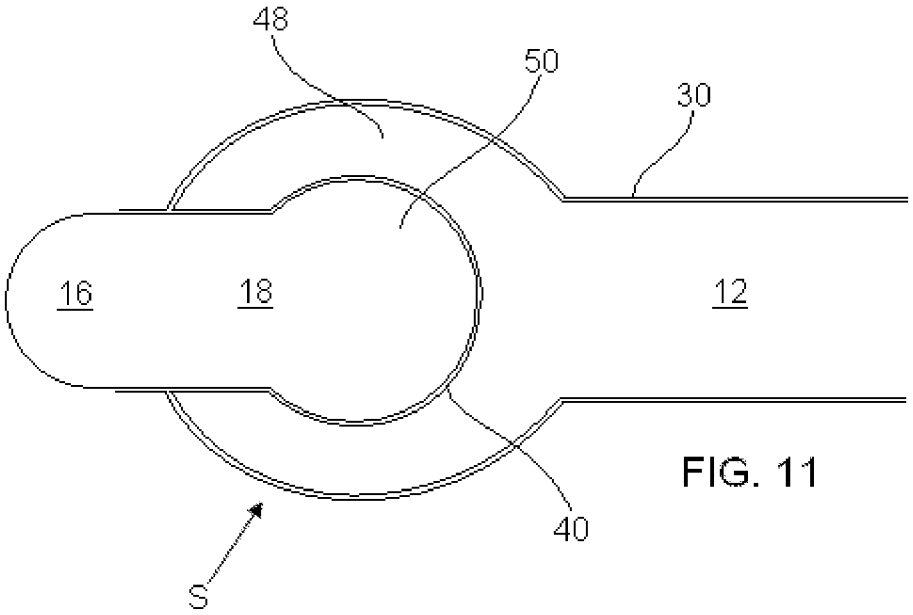

Other interlocking shapes may be used in place of the T-shape shown. For example, FIG. 11 shows one of the axial portions 18 or the axial seals 12 comprising a bulbous recess 48 which interlocks with a bulbous formation 50 of the other of the axial portions or the axial seals. This interlocking arrangement resists movement of the axial portions 18 and the axial seals 12 away from one another and provides a tortuous sealing surface for resisting gas leakage. The channel 30 in FIGS. 10 and 11 is shaped to accommodate the axial portion 18 and axial seal 12 and resists movement of the seals away from one another.

In the embodiments described herein the axial seals 12 extend over a central axial portion of the half shell stator components and the axial portions 18 of the end seals 14 are located at the axial ends of the stator components. The respective lengths of the axial seals 12 and axial portions 18 are selected preferably so that the length of the axial portions 18 is no more than about 50% of the length of the axial seals, preferably less than 25% and more preferably less than 10%. That is, sealing along the longitudinal edges of the axial seals is provided to large extent by the axial seals. A purpose of the axial portions 18 is to space the sealing region S away from the annular portion 16 at the ends of the stator components and to allow two-dimensional sealing.

As previously indicated, the seals are compressed during assembly between the various stator components and undergo expansion. Compression of the axial portions and the axial seals between the axially extending surfaces during assembly causes the axial portions and the axial seals to move into abutment at the mutual contact surface. There may be a small spacing between the seals prior to assembly so that when compressed they move abutment rather than causing stress to be applied by the compression along the sealing surface 40.

The invention claimed is:

1. A multi-stage vacuum pump comprising:

first and second shell stator components arranged to be assembled together along respective axially extending surfaces to define a plurality of pumping chambers along an axis of the pump;

first and second end stator components arranged to be assembled at respective axial ends of the shell stator components;

axial seals for sealing between respective axially extending surfaces of the shell stator components; and end seals having annular portions for sealing between respective first and second end stator components and the shell stator components and axial portions which extend in an axial dimension from the annular portions between the shell stator components for sealing between respective axially extending surfaces of the shell stator components, wherein the end seals are separate from the axial seals.

2. The multi-stage vacuum pump of claim 1, wherein the axial portions extend generally perpendicularly from the annular portions.

3. The multi-stage vacuum pump of claim 1, wherein the axial seals comprise gaskets or the end seals comprise o-rings.

4. The multi-stage vacuum pump of claim 1, wherein compression of the axial portions and the axial seals between the axially extending surfaces during assembly causes the axial portions and the axial seals to move into abutment at the mutual contact surface.

5. The multi-stage vacuum pump of claim 1, wherein the axial portions abut respective axial seals at a mutual contact surface spaced from the annular portions for resisting passage of gas between the axial portions and axial seals along the contact surface.

6. The multi-stage vacuum pump of claim 5, wherein each of the axially extending surfaces of the shell components extend generally in a plane which is transverse to the axis of the pump and the axial seals and the axial portions extend generally in the plane to be seated between respective axially extending surfaces.

7. The multi-stage vacuum pump of claim 5, wherein compression of the axial portions and the axial seals between the axially extending surfaces during assembly causes the axial portions and the axial seals to move into abutment at the mutual contact surface.

8. The multi-stage vacuum pump of claim 6, wherein the axial portions and the axial seals are enlarged in the plane at the mutual contact surface to increase the length of the mutual contact surface.

9. The multi-stage vacuum pump of claim 6, wherein the axial portions and the axial seals are shaped at the mutual contact surface to increase the length of the mutual contact surface beyond the transverse extent of the axial portions and axial seals in the plane.

10. The multi-stage vacuum pump of claim 8, wherein the axial portions and the axial seals interlock at the mutual contact surface to increase the length of the mutual contact surface and resist disengagement of the axial portions from the axial seals.

11. The multi-stage vacuum pump of claim 10, wherein one of the axial portions or the axial seals comprise a recess which interlocks with a complementary shaped formation of the other of the axial portions or the axial seals.

12. The multi-stage vacuum pump of claim 11, wherein one of the axial portions or the axial seals comprise a T-shaped recess which interlocks with a T-shaped formation of the other of the axial portions or the axial seals.

13. The multi-stage vacuum pump of claim 11, wherein one of the axial portions or the axial seals comprise a bulbous recess which interlocks with a bulbous formation of the other of the axial portions or the axial seals.

14. A stator comprising:

first and second shell stator components arranged to be assembled together along respective axially extending surfaces to define a plurality of pumping chambers along an axis of the pump;

first and second end stator components arranged to be assembled at respective axial ends of the shell stator components;

axial seals for sealing between respective axially extending surfaces of the shell stator components; and end seals having annular portions for sealing between respective first and second end stator components and the shell stator components and axial portions which extend in an axial dimension from the annular portions between the shell stator components for sealing between respective axially extending surfaces of the shell stator components, wherein the end seals are separate from the axial seals.

15. The stator of claim 14, wherein the axial portions extend generally perpendicularly from the annular portions.

16. The stator of claim 14, wherein the axial portions abut respective axial seals at a mutual contact surface spaced from the annular portions for resisting passage of gas between the axial portions and axial seals along the contact surface.

17. The multi-stage vacuum pump of claim 16, wherein each of the axially extending surfaces of the shell components extend generally in a plane which is transverse to the axis of the pump and the axial seals and the axial portions extend generally in the plane to be seated between respective axially extending surfaces.

18. The stator of claim 17, wherein the axial portions and the axial seals are enlarged in the plane at the mutual contact surface to increase the length of the mutual contact surface.

19. The stator of claim 17, wherein the axial portions and the axial seals are shaped at the mutual contact surface to increase the length of the mutual contact surface beyond the transverse extent of the axial portions and axial seals in the plane.

20. The multi-stage vacuum pump of claim 18, wherein the axial portions and the axial seals interlock at the mutual contact surface to increase the length of the mutual contact surface and resist disengagement of the axial portions from the axial seals.

21. The multi-stage vacuum pump of claim 20, wherein one of the axial portions or the axial seals comprise a recess which interlocks with a complementary shaped formation of the other of the axial portions or the axial seals.

22. The multi-stage vacuum pump of claim 21, wherein one of the axial portions or the axial seals comprise a T-shaped recess which interlocks with a T-shaped formation of the other of the axial portions or the axial seals.

23. The multi-stage vacuum pump of claim 21, wherein one of the axial portions or the axial seals comprise a bulbous recess which interlocks with a bulbous formation of the other of the axial portions or the axial seals.

* * * * *